US006031437A

United States Patent [19]

Baurand et al.

[11] Patent Number: 6,031,437

[45] Date of Patent: Feb. 29, 2000

[54] SWITCH WITH ELECTROMAGNETIC COMMAND

[75] Inventors: Gilles Baurand, Montesson la Borde; Jean-Christophe Cuny, Rueil-Malmaison; Pierre Duchemin, Fourqueux; Gérald Gaschet, Puteaux; Christian Blanchard, Nanterre, all of France

[73] Assignee: Schneider Electric SA, Boulogne-Billancourt, France

[21] Appl. No.: 09/231,770

[22] Filed: Jan. 15, 1999

[30] Foreign Application Priority Data

Jan. 16, 1998 [FR] France ..... 98 00885

[51] Int. Cl.[7] ..... H01J 9/46

[52] U.S. Cl. ..... 335/6; 335/9; 335/10; 335/23; 335/167; 335/179; 335/181; 335/182; 335/229

[58] Field of Search ..... 335/9, 23, 167, 335/170, 171, 179, 182, 253, 254, 6, 8, 10, 21, 22, 177, 181, 229–234, 275, 276

[56] References Cited

U.S. PATENT DOCUMENTS

| | | | |
|---|---|---|---|
| 3,634,793 | 1/1972 | Sauer | 335/78 |
| 3,708,723 | 1/1973 | Shand et al. | 335/234 |
| 3,783,422 | 1/1974 | Taylor | 335/174 |
| 4,855,701 | 8/1989 | Yokoyama et al. | 335/230 |
| 5,206,618 | 4/1993 | Koch | 335/253 |
| 5,300,906 | 4/1994 | Blanchard et al. | 335/167 |

FOREIGN PATENT DOCUMENTS

| | | |
|---|---|---|
| 1 639 389 | 4/1971 | Germany . |
| WO 91/02370 | 2/1991 | WIPO . |

*Primary Examiner*—Michael L. Gellner
*Assistant Examiner*—Raymond Barrera
*Attorney, Agent, or Firm*—Oblon, Spivak, McClelland, Maier & Neustadt, P.C.

[57] ABSTRACT

A switching apparatus including an electromagnetic command device fitted with a magnetic circuit made up of a main circuit polarized by a permanent magnet and linked to a depolarizing coil and through a movable circuit integral with a movable support subject to a return spring and acting directly or indirectly on at least one disconnecting pole. The main magnetic circuit has at least two air gaps in series on the path of the magnetic flux generated by the permanent magnet and the movable magnetic circuit includes at least two parts capable of closing the air gaps when the main magnetic circuit and the movable magnetic circuit are joined together and are crossed by the magnetic flux created by the permanent magnetic, thereby carrying out a locking function and creating a multiplication of the locking forces, with an unlocking function being provided by the depolarization coil the counter-flux from which crosses the magnetic circuit and air gaps.

9 Claims, 3 Drawing Sheets

SWITCH WITH ELECTROMAGNETIC COMMAND

BACKGROUND OF THE INVENTION

1. Field of the Invention

This invention relates to an electromagnetically commanded switch comprising a magnetic circuit made up of a main circuit polarised by a permanent magnet and linked to a depolarisation coil and a movable circuit integral with a movable support, subject to a return spring and acting directly or indirectly on at least one disconnecting pole.

2. Discussion of the Background

In order to provide protection for motors against short circuits or overcurrents, thermal relays, motor cut-outs or contact maker/circuit breakers are used.

Through U.S. Pat. No. 5,332,986 or patent application DE 195 14 314, an electromagnetic actuator is known, comprising a magnetic circuit polarized by a permanent magnet and linked to a coil and made up of a fixed part and a movable part, the latter serving as an actuator. In U.S. Pat. No. 53,332,986, the coil is commanded from current sensors and the movable part of the magnetic circuit is integral with an adjusting lever acting on a contact that is ancillary to the power poles.

SUMMARY OF THE INVENTION

The purpose of this invention is to provide an electromagnetic device for commanding the poles, of the type with polarization by a permanent magnet and depolarization by a coil, capable of producing a large force to lock the movable part which is intended after release to operate the power poles.

The apparatus is characterised by the fact that the main magnetic circuit has at least two air gaps in series over the path of the magnetic flux generated by the permanent magnet, the movable magnetic circuit being made up of at least two parts capable of closing these air gaps when the main magnetic circuit and the movable magnetic circuit are joined together and are crossed by said magnetic flux created by the permanent magnet thereby carrying out a locking function and creating a multiplication of the locking forces, the unlocking being provided by the depolarisation coil, the counter-flux from which crosses the magnetic circuit and air gap assembly.

BRIEF DESCRIPTION OF THE DRAWINGS

The invention will now be described in more detail making reference to embodiments given by way of examples and represented by the appended drawings in which.

DESCRIPTION OF THE PREFERRED EMBODIMENTS

Figure 1:
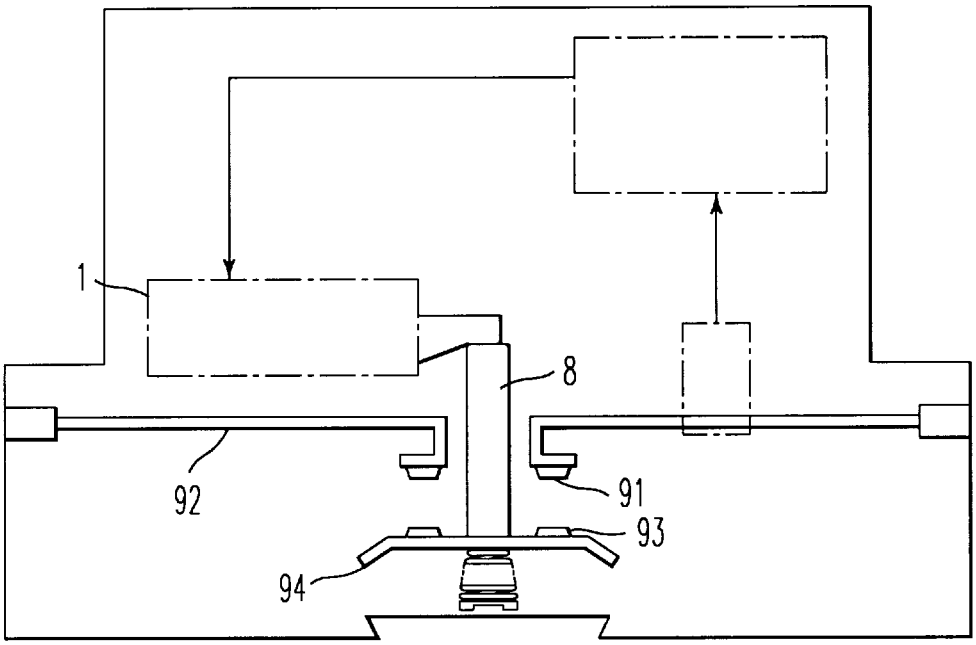
FIG. 1 is a diagram of an apparatus fitted with an electromagnetic device according to the invention.

FIG. 1 shows an apparatus commanded electromagnetically, fitted with an electromagnetic device, indicated in its totality by reference number 1, which is used to command the poles of this apparatus.

The switching apparatus comprises, for each phase, a disconnection chamber used as a housing for a disconnection pole. In FIG. 1, this pole is of the double disconnection type and comprises two fixed contacts 91 attached to conductive components 92 to which two power terminals are connected. Opposite these fixed contacts there are movable contacts 93 attached to a contact bridge 94. The contact bridges 94 are carried on a contact carrier 8.

The device 1 is made up of a magnetic circuit 2–4 which is polarized by a permanent magnet 3 and is linked to a depolarization coil 5. The magnetic circuit is made up of a fixed main circuit 2, made of mild silicon steel, and a movable circuit 4, also made of mild silicon steel.

The movable circuit 4 is assembled with a lever 6 which is pivotally mounted about a spindle 61 and acts on the contact carrier 8 of the apparatus through its extremity 62. This lever 6 is subjected to a tripping force which tends to make it tilt and to displace the contact carrier 8 in the direction of opening the contacts after having been released by the device described below. This force is caused by a spring 7.

The main part 2 of the magnetic circuit has at least two air gaps 21 and 22. The movable circuit 4 is made up of two sections 41 and 42 which close the magnetic circuit at the air gaps 21 and 22, when the two parts 2 and 4 of the magnetic circuit are joined.

When the circuits 2 and 4 are joined, the two parts 41, 42 of the movable magnetic circuit close the air gaps, and the permanent magnet 3 creates a magnetic flux $\phi$ which holds the two circuits 2 and 4 joined together. The flux passing through the contact zones, between the fixed circuit 2 and the movable circuit 4, causes multiplication of the joining force (locking function) thanks to the multiplicity of contact zones, by using the same flux several times.

When the coil 5 is powered up, it creates a counter-flux flowing in the opposite direction to flux $\phi$ created by the permanent magnet 3, which has the effect of releasing the lever 6 which then pivots under the action of the spring 7. It should be noted that the counter-flux generated by the coil 5 crosses the assembly formed by the magnetic circuit and the in series air gaps.

The electromagnetic device 1 is commanded from the current sensors via an electronic circuit which receives the signals from the sensors, processes them in a way that detects short circuits or overload currents, and if such a defect is apparent, sends a command signal to the coil 5.

Figure 2:
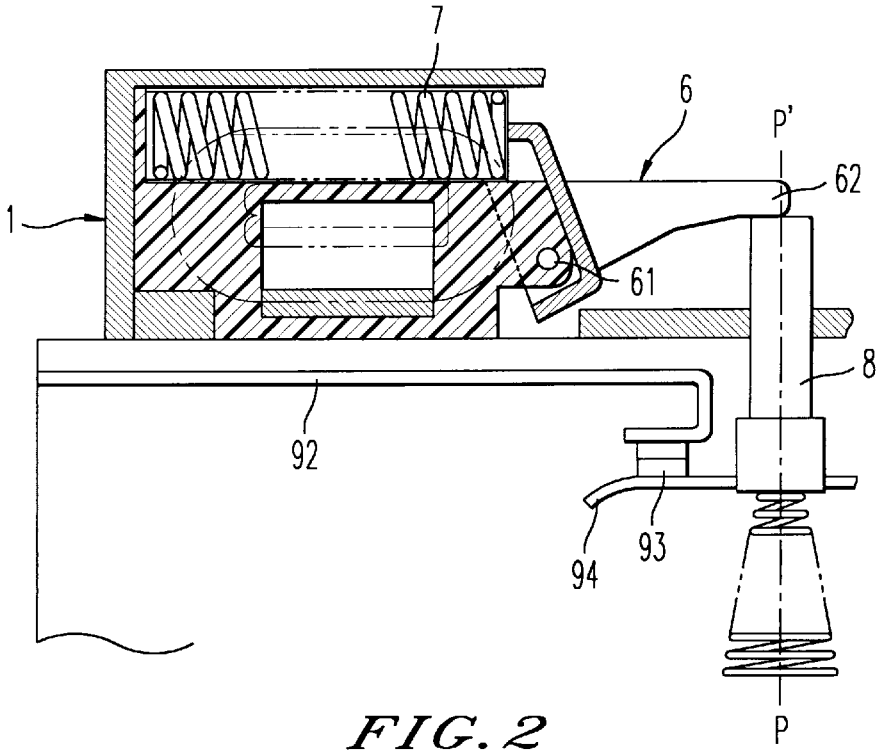
FIG. 2 shows an embodiment of the electromagnetic device according to the invention.
Figure 3:
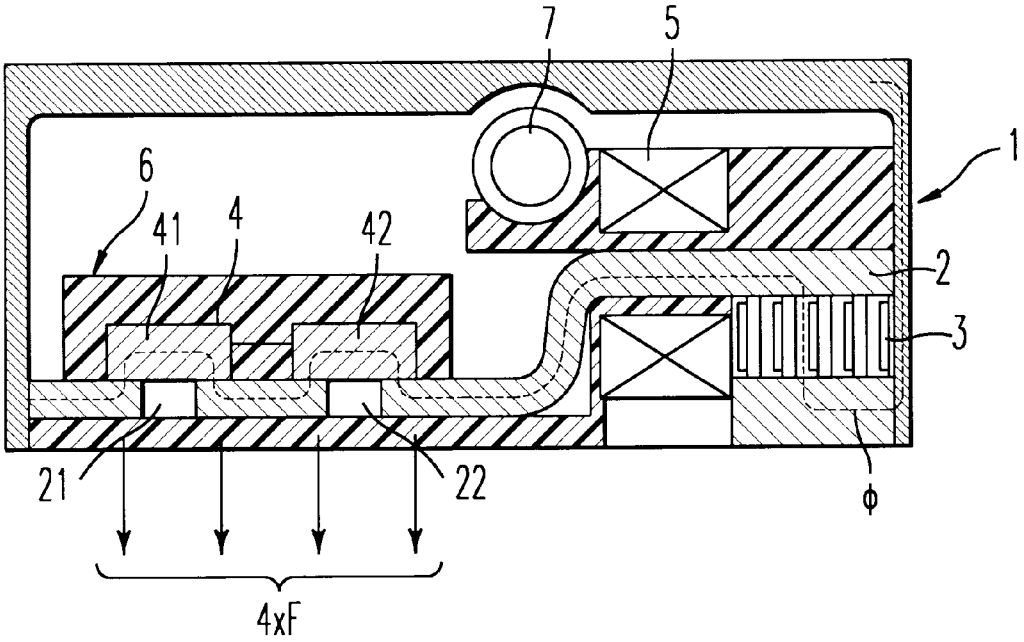
FIG. 3 is a cross-section of the device in FIG. 2 shown in the locking position
Figure 4:
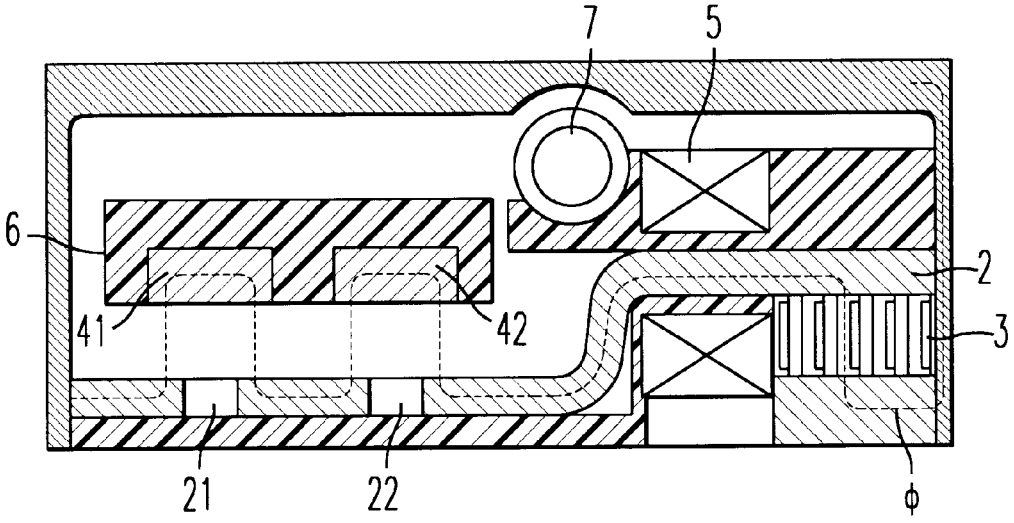
FIG. 4 is a cross-section of the device in FIG. 2 shown in the "released" position.

In the embodiment in FIGS. 2 to 4, the spring 7 extends in the central part, the lever 6 carrying the movable circuit 4 being positioned on one side of this spring, the coil 5 and the permanent magnet being positioned on the other side of this spring. The spring 7 extends in such a way that its axis is substantially perpendicular to the plane P-P' of translation of the contact carrier 8.

Figure 5:
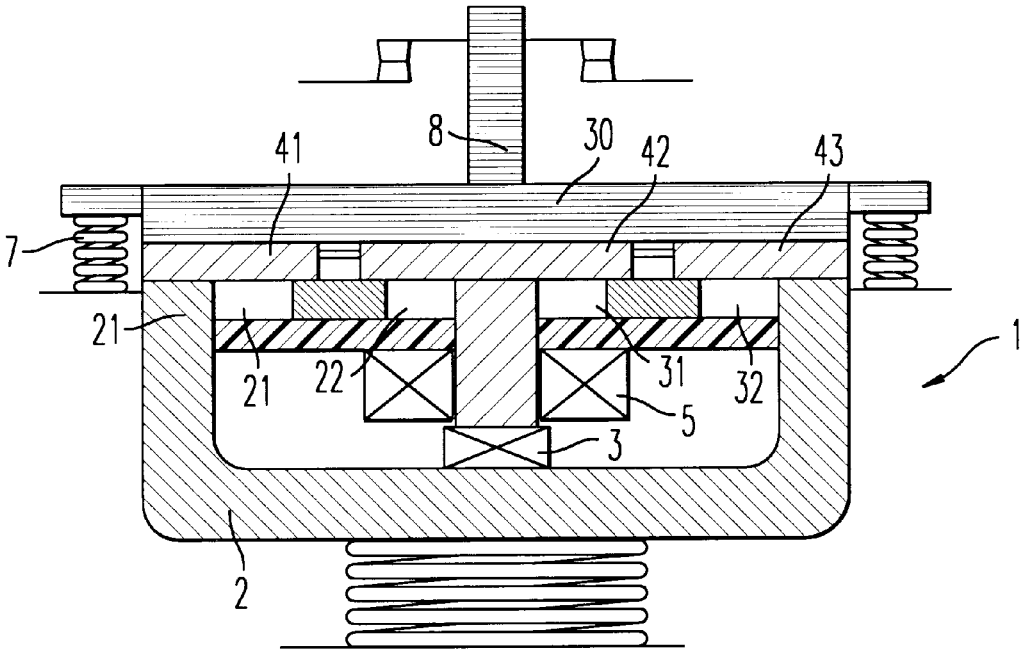
FIG. 5 is a variant of the device in FIG. 2.
Figure 6:
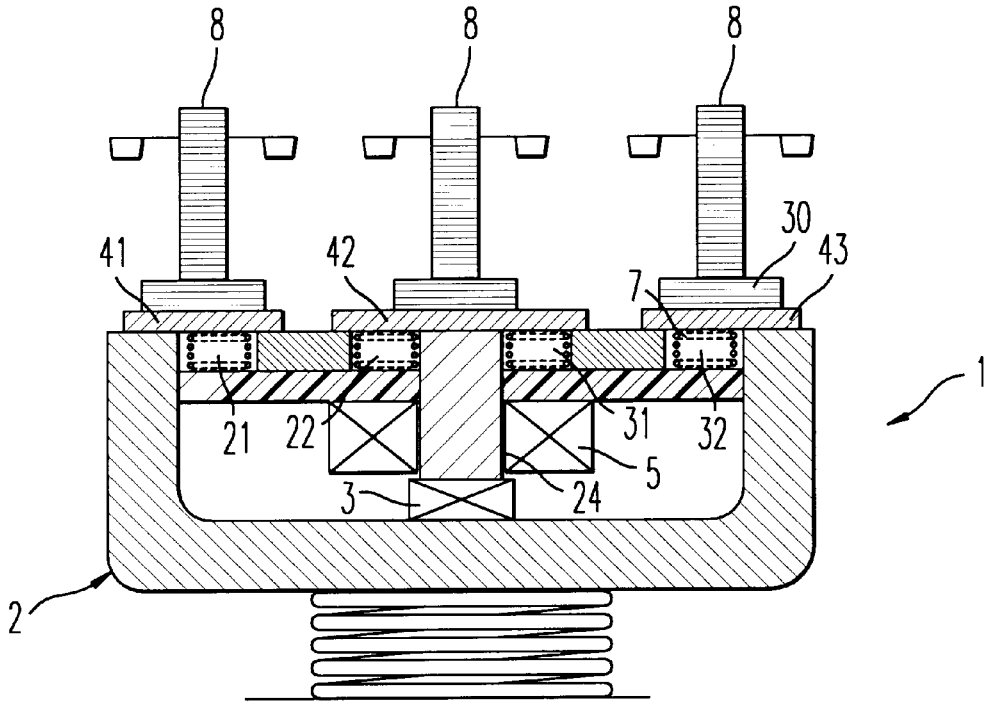
FIG. 6 is a variant of the device in FIG. 2.

In the embodiments of FIGS. 5 and 6, the magnetic flux passes through a central core 24 passing through the coil 5.

In the embodiment in FIGS. 5 and 6, the electromagnetic device 1 includes a magnetic circuit having a U-shaped main circuit 2 polarized by a permanent magnet 3 and linked to a depolarizing coil 5 and having at least four air gaps 21, 22, 31, 32 extending in series over a portion of a valley of the U-shaped main circuit 2 on a magnetic flux path generated by the permanent magnet 3. Also included is a movable magnetic circuit integral with a movable support 30 subject to a return spring 7 and having at least first, second and third magnetic parts 41, 42, 43 configured to close the at least four air gaps 21, 22, 31, 32, when the U-shaped main circuit 2 and the movable magnetic circuit 11 are joined together and are crossed by the magnetic flux created by the permanent magnet 3. Thus, a locking function is performed and a multiplication of the locking forces is created. Also, an unlocking function is provided by the depolarization coil 5 and a counter-flux from which crosses the magnetic circuit and the at least four air gaps 21, 22, 31 and 32. Further, in FIG. 5 the movable support 30 is a single member fixed to the first, second and third magnetic parts 41, 42 and 43 and contacts a single contact carrier 8. In FIG. 6, the moveable movable support 30 includes three moveable support members respectively fixed to the first, second and third magnetic parts 41, 42 and 43 and the three moveable support members respectively contact three contact carriers 8.

It is of course understood that, without departing from the scope of the invention, one can envisage variants of the invention and ways of perfecting the detail of it and even envisage the use of equivalent means.

We claim:

1. A switching apparatus having an electromagnetic command device comprising:

a magnetic circuit having:

a main circuit polarized by a permanent magnet and linked to a depolarizing coil, and having at least two air gaps in series on a magnetic flux path generated by the permanent magnet; and a movable holder integral with a movable lever subject to a return spring and having at least first and second magnetic parts respectively disposed within portions of the movable holder and configured to close the at least two air gaps when the main circuit and the movable holder are joined together and are crossed by said magnetic flux path created by the permanent magnet, thereby performing a locking function and creating a multiplication of the locking forces, with an unlocking function being provided by the depolarization coil and a counter-flux from which crosses the magnetic circuit and the at least two air gaps, wherein the moveable lever acts directly or indirectly on at least one disconnecting pole.

2. An apparatus according to claim 1, wherein the movable holder is fixed to the movable lever acting on the at least one disconnecting pole.

3. An apparatus according to claim 1, further comprising:

an electronic circuit including current sensors and configured to detect short circuits or overload currents and, if such a fault is detected, send a command signal to the depolarizing coil of the electromagnetic command device.

4. An apparatus according to any one of the preceding claims, wherein the spring extends within a central part of the electromagnetic command device, the moveable lever being arranged on one side of the spring, and the depolarizing coil and the permanent magnet being arranged on the other side of the spring.

5. An apparatus according to claim 2, further comprising:

an electronic circuit including current sensors and configured to detect short circuits or overload currents and, if such a fault is detected, send a command signal to the depolarizing coil of the electromagnetic command device.

6. A switching apparatus including an electromagnetic command device comprising:

a magnetic circuit having:

a U-shaped main circuit polarized by a permanent magnet and linked to a depolarizing coil, and having at least four air gaps extending in series over a portion of a valley of the U-shaped main circuit on a magnetic flux path generated by the permanent magnet; and a movable magnetic circuit integral with a movable support subject to a return spring and having at least first, second and third magnetic parts configured to close the at least four air gaps when the U-shaped main circuit and the movable magnetic circuit are joined together and are crossed by said magnetic flux created by the permanent magnet, thereby performing a locking function and creating a multiplication of the locking forces, with an unlocking function being provided by the depolarization coil and a counter-flux from which crosses the magnetic circuit and the at least four air gaps.

7. An apparatus according to claim 6, wherein the support is a single member fixed to the first, second and third magnetic parts and contacts a single contact carrier.

8. An apparatus according to claim 6, wherein the movable support comprises three moveable support members respectively fixed to the first, second and third magnetic parts, and wherein the three moveable support members respectively contact three contact carriers.

9. An apparatus according to claim 6, further comprising:

an electronic circuit including current sensors and configured to detect short circuits or overload currents and, if such a fault is detected, send a command signal to the depolarizing coil of the electromagnetic command device.

* * * * *